US006626184B1

(12) United States Patent
Cheng

(10) Patent No.: US 6,626,184 B1
(45) Date of Patent: Sep. 30, 2003

(54) OPEN-LOOP HEADBAND ASSEMBLY WITH A FLICKERING DECORATION LIGHT DEVICE

(76) Inventor: Chen-An Cheng, No. 33, Lane 340, Section 1, Hai Tien Road, Tainan (TW)

( * ) Notice: Subject to any disclaimer, the term of this patent is extended or adjusted under 35 U.S.C. 154(b) by 0 days.

(21) Appl. No.: 10/131,402

(22) Filed: Apr. 25, 2002

(51) Int. Cl.[7] ..... A45D 8/12; A42B 1/24

(52) U.S. Cl. ..... 132/275; 2/209.13; 2/171

(58) Field of Search ..... 132/275, 278, 132/273; 2/209.13, 209.14, 174, 171, DIG. 11; D28/39, 41

(56) References Cited

U.S. PATENT DOCUMENTS 6,047,709 A * 4/2000 Tu ..... 132/275
6,289,903 B1 * 9/2001 Haufler ..... 132/275
6,382,218 B1 * 5/2002 Cheng ..... 132/275
6,513,167 B1 * 2/2003 Cheng ..... 2/171

* cited by examiner

*Primary Examiner*—John J. Wilson
*Assistant Examiner*—Robyn Kieu Doan
(74) *Attorney, Agent, or Firm*—Rosenberg, Klein & Lee

(57) ABSTRACT

An open-loop headband assembly includes an open-loop headband and a flickering decoration light device. The flickering decoration light device is provided on the top of the headband and composed by one or more elastic rods and a switching kit. Each elastic rod is made of elastic coil, and at least one flickering diode is provided in the top end of each elastic rod. The flickering diode is covered by a decorative block. The switching kit is disposed on the headband and composed by an electric circuit plate and a cover with a through hole. A battery and a pressing switch are disposed on the electric circuit plate. Wires extend from the bottom of the electric circuit plate and penetrate through the interior of each elastic rod to connect with each flickering diode. The pressing switch protrudes outward the through hole after the cover being assembled with the electric circuit plate.

3 Claims, 6 Drawing Sheets

OPEN-LOOP HEADBAND ASSEMBLY WITH A FLICKERING DECORATION LIGHT DEVICE

BACKGROUND OF THE INVENTION

1. Field of the Invention

The present invention relates to an open-loop headband assembly with a flickering decoration light device. The present invention relates, more particularly, to an open-loop headband assembly which can be worn for the purpose of decoratively controlling hair wherein a flickering decoration light device is firmly secured to the top of an open-loop headband.

2. Description of the Related Art

Probably the simplest form of head wear is the open-loop headband. The open-loop headband, which extends over the top of the head of a wearer, is used to secure the hair of a wearer so as to keep it away from the face. Various ornamental implements will be provided on the top surface of conventional open-loop headband open-loop headbands, but the conventional headbands still look stiff, plane and dull and lack attraction by women or young girls.

SUMMARY OF THE INVENTION

Accordingly, the present invention is directed to an open-loop headband assembly with a flickering decoration light device that can substantially obviate the drawbacks of known ornamental implements and enhance the aesthetic and vivid effects beyond those of conventional open-loop headbands.

An object of the present invention is to provide an open-loop headband assembly with a flickering decoration light device which can be worn for the purpose of decoratively controlling hair of a wearer.

Another object of the present invention is to provide an open-loop headband assembly having a flickering decoration light device that is firmly secured to the top of a headband so as for the headband to look vivid and shining.

Yet another object of the present invention is to provide an open-loop headband assembly with a flickering decoration light device whose elastic rods will swing rhythmically by the move of a wearer's body and head or the influence of external forces.

To achieve these advantages, an open-loop headband assembly with a flickering decoration light device in the present invention includes an open-loop headband and a flickering decoration light device. The flickering decoration light device is provided on the top of the open-loop headband and composed by one or more elastic rods and a switching kit. Each elastic rod is made of elastic coil, and at least one flickering diode is provided in the top end of each elastic rod. The at least one flickering diode as well as the top end of each elastic rod is covered by a decorative block. The switching kit is disposed on the headband near the bottom end of the one or more elastic rods and composed by an electric circuit plate and a cover with a through hole. A battery and a pressing switch are disposed on the electric circuit plate, and a plurality of wires extend from the bottom of the electric circuit plate and penetrate through the interior of the one or more elastic rods to connect with the bottom end of the flickering diode in the top end of each elastic rod. The pressing switch will protrude outward the through hole after the cover being assembled with the electric circuit plate.

BRIEF DESCRIPTION OF THE DRAWINGS

The many features and advantages of the present invention will become apparent in the following detailed description of the preferred embodiments with reference to the accompanying drawings, in which.

DETAILED DESCRIPTION OF THE PREFERRED EMBODIMENTS

Figure 1:
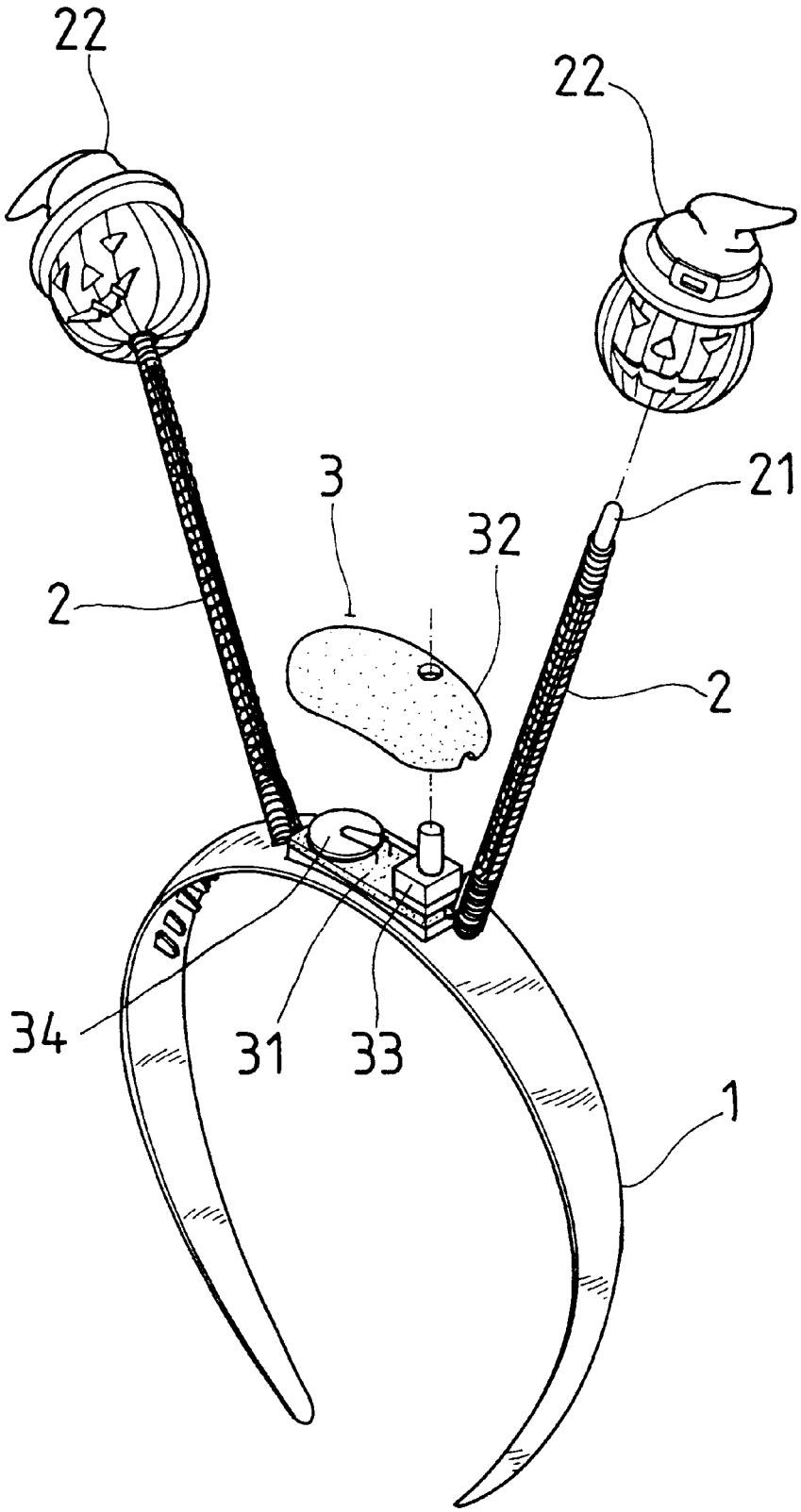
FIG. 1 is a perspective exploded view of an embodiment of an open-loop headband assembly with a flickering light device in accordance with the present invention.

Referring to FIG. 1, a preferred embodiment of an open-loop headband assembly with a flickering light device in the present invention includes an open-loop headband 1 and a flickering decoration light device. The open-loop headband 1 is provided to be worn on the head of a wearer with two legs straddling the wearer's head and bearing against the sides of her head.

Figure 4:
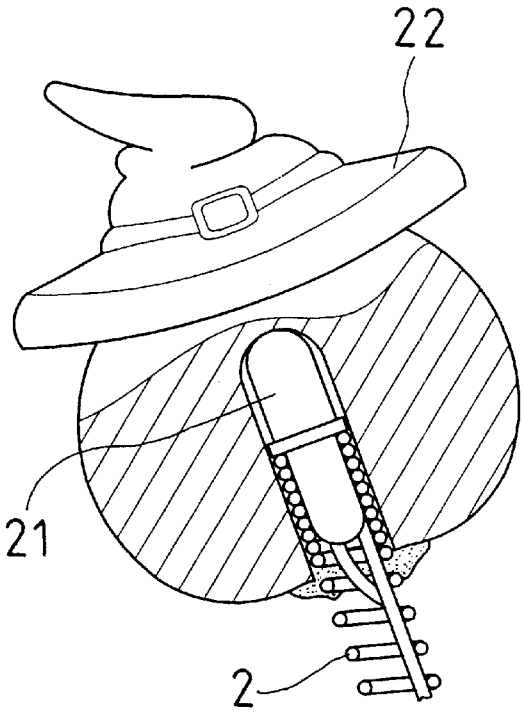
FIG. 4 is a front elevation view of an embodiment of one flickering diode in the top end of the elastic rod being provided in the decorative block by gluing in accordance with the present invention.
Figure 5:
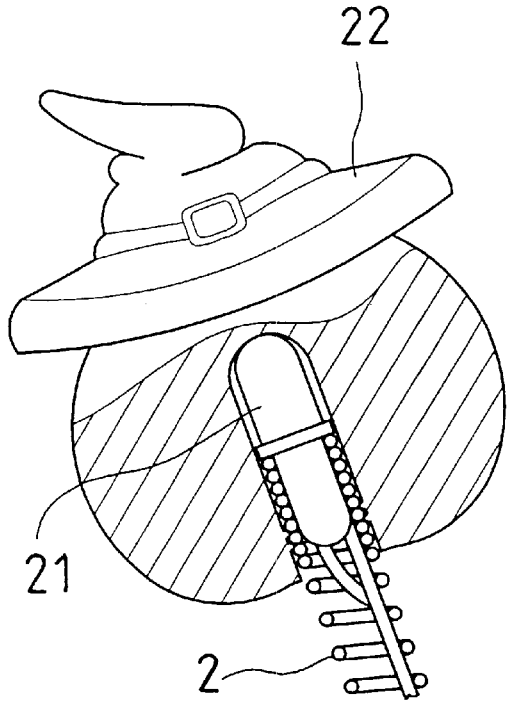
FIG. 5 is a front elevation view of an embodiment of one flickering diode in the top end of the elastic rod being provided in the decorative block by screwing in accordance with the present invention.
Figure 7:
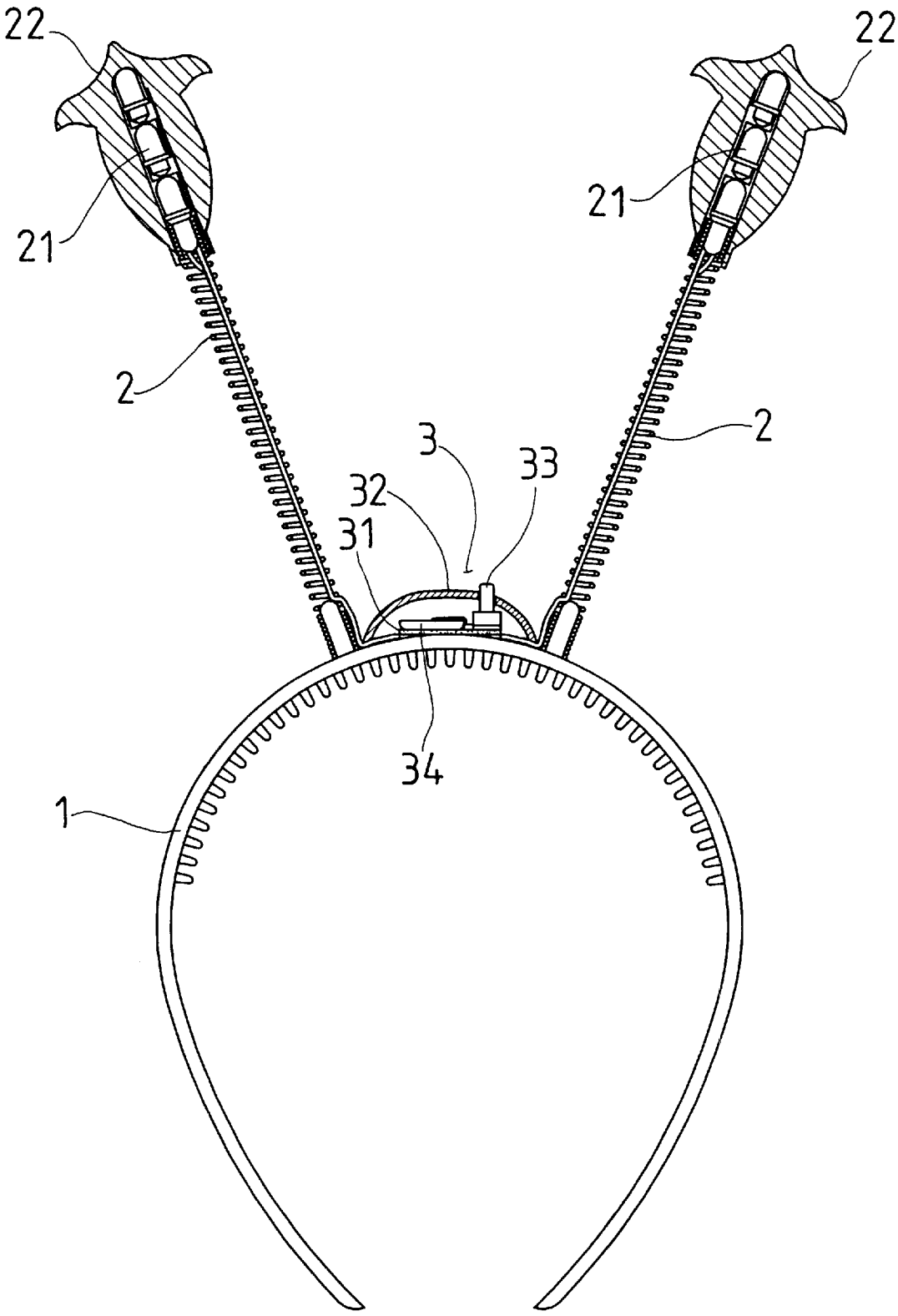
FIG. 7 is a front elevation view of an embodiment of an open-loop headband assembly with a flickering light device in accordance with the present invention that is provided with a plurality of flickering diodes in the top end of the elastic rod being covered by another configuration of decorative block.
Figure 8:
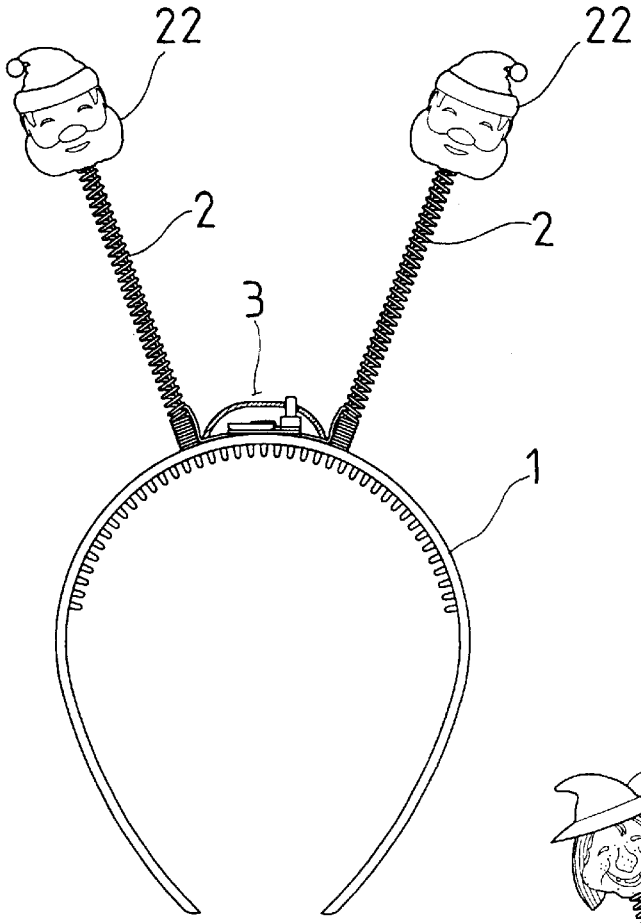
FIG. 8 is a front elevation view of an embodiment of an open-loop headband assembly with a flickering light device in accordance with the present invention that is provided with a further configuration of decorative block; and, FIG. 9 is a front elevation view of an embodiment of an open-loop headband assembly with a flickering light device in accordance with the present invention that is provided with a further configuration of decorative block.
Figure 9:
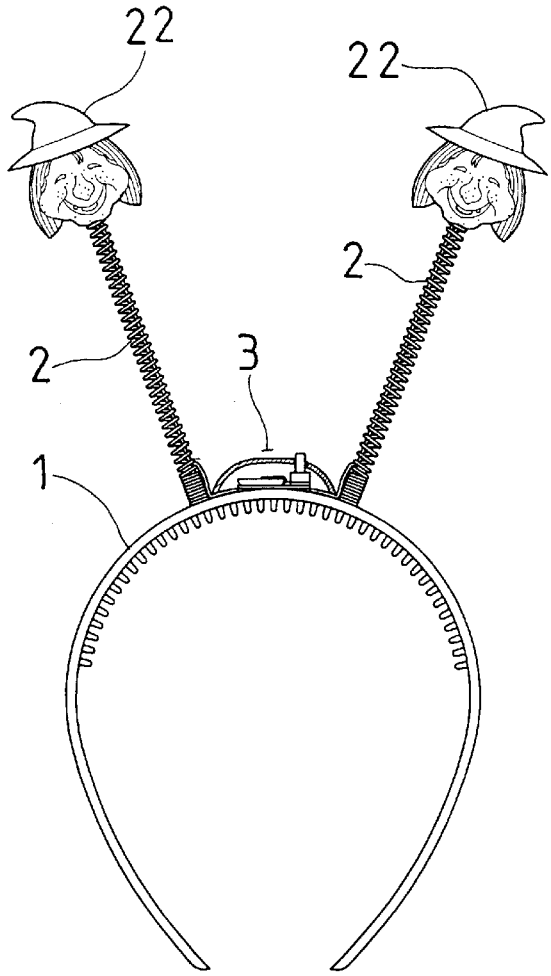

The flickering decoration light device is provided on the top of the open-loop headband 1 and composed by one or more elastic rods 2 and a switching kit 3. Each elastic rod 2 is made of elastic coil, and at least one flickering diode 21 is provided in the top end of each elastic rod 2. The at least one flickering diode 21 as well as the top end of each elastic rod 2 is covered by a decorative block 22. The top end of each elastic rod 2 is inlaid in the interior of each and each decorative block 22 by gluing or screwing, referring to FIGS. 4 and 5. Each decorative block 22 is made of transparent material and may be any kind of configuration, referring to FIGS. 7, 8 and 9.

Figure 2:
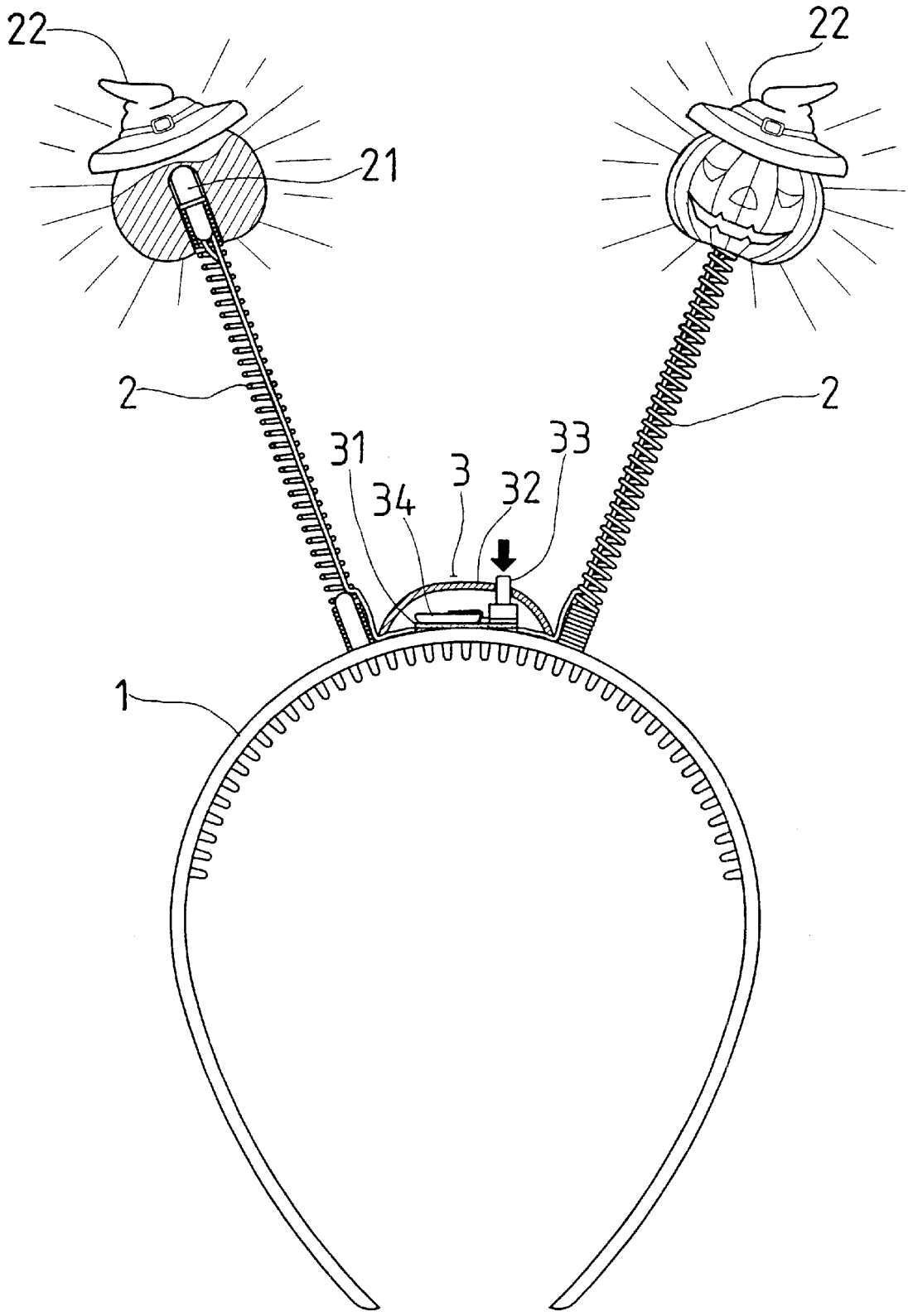
FIG. 2 is a schematic front elevation view of an embodiment of an open-loop headband assembly with a flickering light device in assembled configuration in accordance with the present invention.
Figure 3:
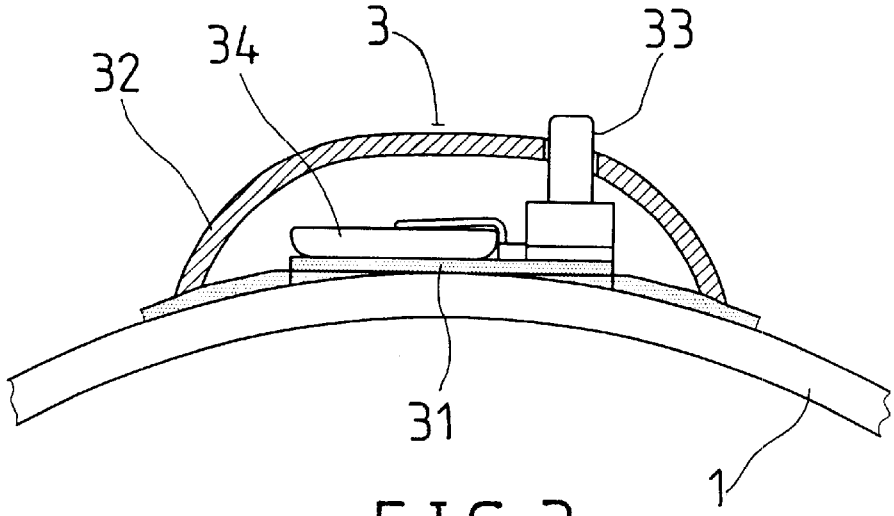
FIG. 3 is a front elevation view of an embodiment of the switch kit in assembled configuration in accordance with the present invention.

Referring to FIGS. 2 and 3, the switching kit 3 is disposed on the open-loop headband 1 near the bottom end of the one or more elastic rods 2 and composed by an electric circuit plate 31 and a cover 32 with a through hole. A pressing switch 33 and a battery 34 are disposed on the electric circuit plate 31, and a plurality of wires extend from the bottom of the electric circuit plate 31 and penetrate through the interior of the one or more elastic rods 2 to connect with the bottom end of the flickering diode 21 in the top end of each elastic rod 2. The pressing switch 33 will protrude outward the through hole of the cover 32 after the cover 32 being assembled with the electric circuit plate 31.

Figure 6:
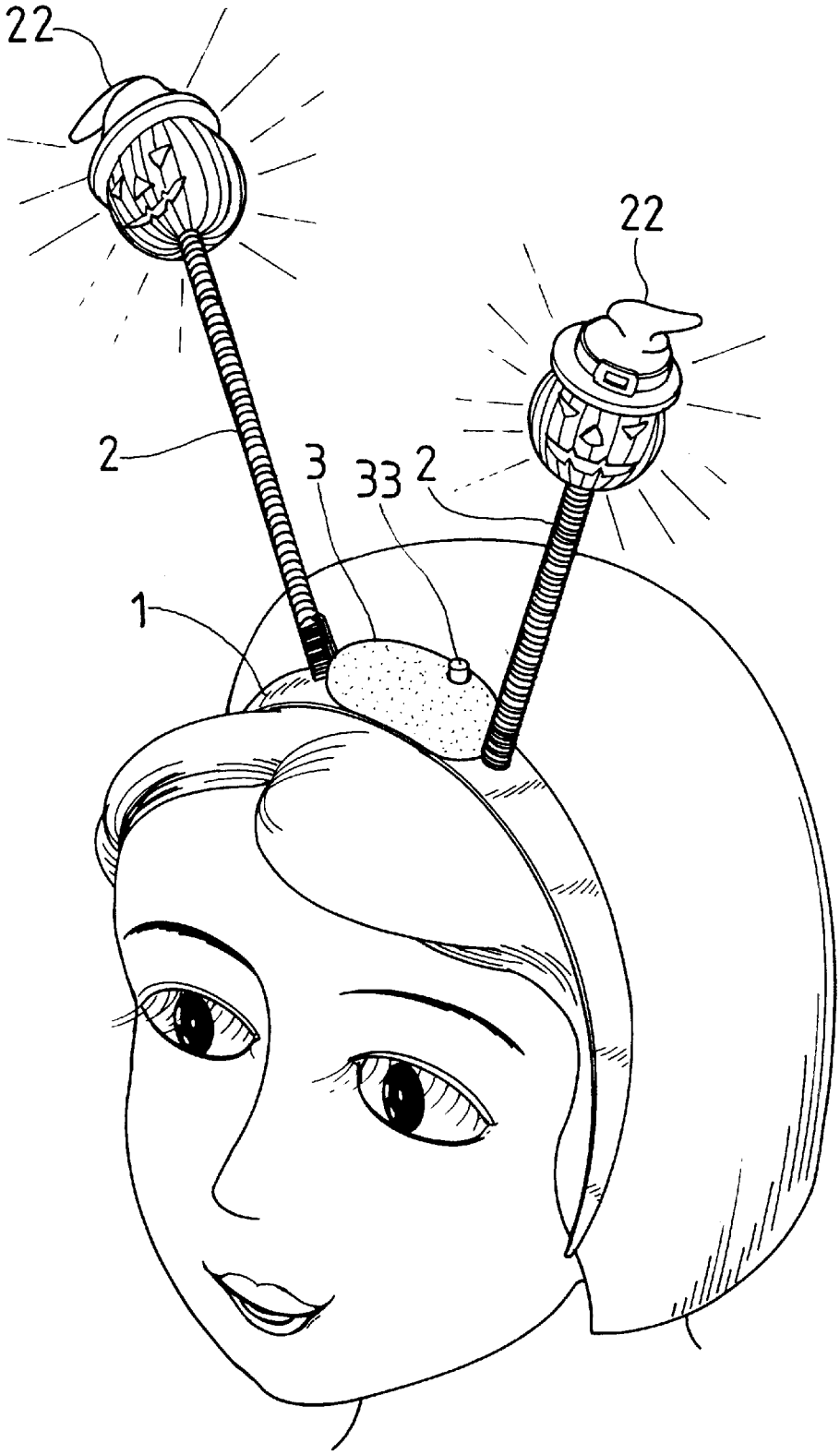
FIG. 6 is a perspective schematic view of an embodiment of an open-loop headband assembly with a flickering light device in accordance with the present invention being worn by a wearer.

Referring to FIG. 6, while being applied, the whole open-loop headband assembly can be conveniently and firmly worn on the head of a wearer with two legs of the headband 1 straddling the wearer's head and bearing against the sides of her head. The pressing switch 33 is pressed down to touch the electric circuit plate 31 to conduct electricity to the at least one flickering diode 21 in each elastic rod 2 so as to make the at least one flickering diode 21 keep flickering and to let the headband 1 look vivid and shining because of the one or more transparent decorative blocks 22 and the swing of one or more elastic rods 2 by the move of the wearer. When the pressing switch 33 is pressed down again, the electric circuit will be cut off, and the at least one flickering diode 21 in each elastic rod 2 will be extinguished.

While the preferred embodiments of the invention have been described above, it will be recognized and understood that various modifications may be made thereto, and the appended claims are intended to cover all such modifications which may fall within the spirit and scope of the invention.

What is claimed is:

1. An open-loop headband assembly with a flickering light device comprising:

an open-loop headband being provided to be worn on the head of a wearer with two legs straddling the wearer's head and bearing against the sides of her/his head; and, a flickering decoration light device being provided on the top of said open-loop headband and composed by one or more elastic rods and a switching kit, each elastic rod being made of elastic coil, at least one flickering diode being provided in the top end of said each elastic rod, said at least one flickering diode as well as the top end of said each elastic rod being covered by a decorative block, said each decorative block being made of transparent material, said switching kit being disposed on said open-loop headband near the bottom end of said one or more elastic rods and composed by an electric circuit plate and a cover with a through hole, a pressing switch and a battery being disposed on said electric circuit plate, a plurality of wires extending from the bottom of said electric circuit plate and penetrating through the interior of said one or more elastic rods to connect with the bottom end of said flickering diode in the top end of said each elastic rod, and said pressing switch protruding outward said through hole of said cover after said cover being assembled with said electric circuit plate.

2. The open-loop headband assembly with a flickering light device as recited in claim 1, wherein the top end of said each elastic rod is inlaid in the interior of said each decorative block by gluing or screwing.

3. The open-loop headband assembly with a flickering light device as recited in claim 2, wherein said each decorative block may be any kind of configuration.

* * * * *